United States Patent [19]

Sieck et al.

[11] 4,434,890

[45] Mar. 6, 1984

[54] PACKAGING CONTAINER FOR SENSITIVE PRODUCTS

[75] Inventors: Reinhard Sieck, Cologne; Gerhard Brüsewitz, Berg.-Gladbach, both of Fed. Rep. of Germany

[73] Assignee: Dr. Madaus & Co., Cologne, Fed. Rep. of Germany

[21] Appl. No.: 331,343

[22] Filed: Dec. 16, 1981

[30] Foreign Application Priority Data

Dec. 16, 1980 [DE] Fed. Rep. of Germany ... 8033376[U]

[51] Int. Cl.[3] ..... B65D 81/30; B65D 85/62; G01N 1/10

[52] U.S. Cl. ..... 206/443; 206/45.19; 220/450; 229/3.5 MF

[58] Field of Search ..... 206/443, 45.19, 522, 206/523; 220/450; 229/29 E, 29 F, 3.5 MF

[56] References Cited

U.S. PATENT DOCUMENTS

| | | | |
|---|---|---|---|
| 2,322,345 | 6/1943 | Cage | 220/450 |
| 2,954,913 | 10/1960 | Rossman | 220/450 |
| 3,142,599 | 7/1964 | Chavannes | 206/522 |
| 3,344,973 | 10/1967 | Studen | 206/523 |
| 3,682,597 | 8/1972 | Husch | 206/45.19 |

*Primary Examiner*—William T. Dixson, Jr.
*Attorney, Agent, or Firm*—Felfe & Lynch

[57] ABSTRACT

The present invention provides a temperature-stabilizing packaging container for condensation sensitive, water containing products in closed tubes, especially semi-solid test media such as immersion nutrient substrate carriers for the determination of micro-organisms or the like. The packaging container comprises a strip-like, heat-insulating material, at least one of the surfaces of which is provided with a radiation-repelling, metallic covering.

15 Claims, 4 Drawing Figures

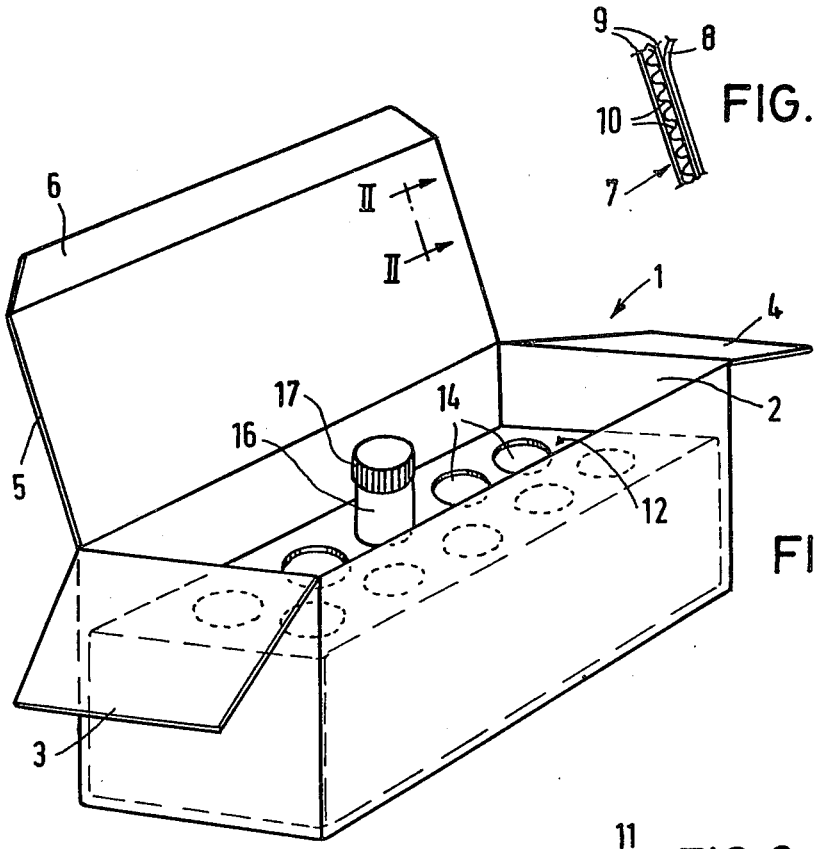
FIG.1
FIG.2
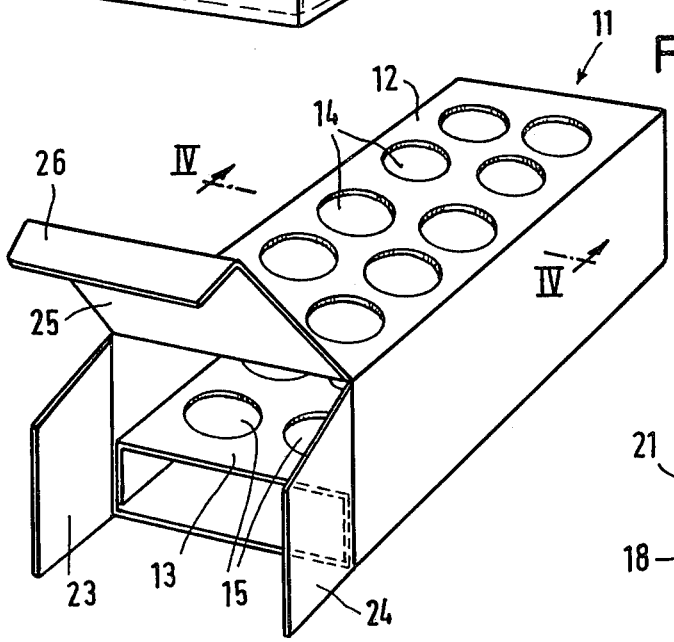
FIG.3
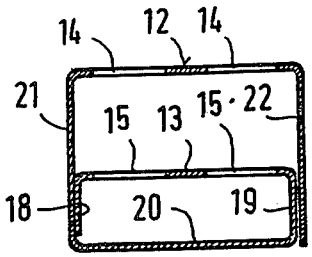
FIG.4

PACKAGING CONTAINER FOR SENSITIVE PRODUCTS

The present invention is concerned with a temperature-stabilizing packaging container for condensation sensitive, water-containing products in closed tubes, especially semi-solid test media such as immersion nutrient substrate carriers for the determination of micro-organisms and the like.

Immersion nutrient substrate carriers, which are used in serological and microbiological diagnoses, consist of a substrate which is coated with a nutrient agar having a high water content in a closed tube. Since the atmosphere in the tube is thus saturated with water, condensed water forms in the tube and considerably limits the storage stability of the nutrient agar. In the case of comparatively frequent temperature variations, the formation of condensed water increases, the nutrient agar dries out and the substrate becomes useless for diagnostic purposes.

It is known that the storage temperature and fluctuations are the main influencing factors the storage of these materials. These factors induce chemical reactions and changes in the colloidal structure of the substrates, as well as the formation of condensate.

Since the air space in the tube is saturated by the aqueous substrate present therein up to 100% relative atmospheric humidity, when the wall of the tube is cooled, it goes below the dew point. The deposition of condensed water is therefore dependent upon the amount of the temperature change ($\Delta t$) and the rate of change. Only in the case of small and very slow temperature changes can the aqueous substrate take up water from the air in the tube to maintain equilibrium and thus reduce or avoid condensation. The storage of these products should thus take place at a low temperature but not at about or below the freezing point since the gel structure would then be destroyed. Furthermore, rapid changes of the temperature should be avoided. Such storage could hitherto only take place in special and expensive apparatus. Storage in a conventional refrigerator with the usual self-defrosting device is, because of the frequent change of the cooling phases, especially harmful for the storage stability (for example 10 cooling phases per day with a $\Delta t$ in each case of 5° C. and thus with a total $\Delta t$ of 50° C. per day).

Storage in laboratories or in working or other rooms also impairs the storage stability since, the usual room temperature change produce very unfavourable temperature conditions.

An attempt has already been made to increase the storage stability of such sensitive products by a special construction of a packaging container for receiving them. For this purpose, packaging containers have been made of foamed materials. However, in essence, only a direct transmission of heat is hereby made difficult. The degree of action due to radiations of various kinds, for example that from the walls of the storage room and the like, is, however, scarcely reduced. In the case of storage in a room subjected to temperature variations, the contents of such a packaging container are exposed to radiation influences which can lead to a warming up of one side of the tubes in a packaging container, so that condensate can again be formed on the non-warmed side of the tube. Furthermore, insulation or temperature fluctuation-reducing measures only lead, in relation to heat transmission, to extremely voluminous packagings and thus to unacceptably high production of waste and storage space requirements.

It is an object of the present invention so to construct a packaging container for sensitive products in closed tubes that the products, independetly of their storage conditions, are substantially protected against the influences of heat so that condensate formation and drying out of nutrient substrate are practically inhibited and the storage stability of the substrate is improved.

Thus, according to the present invention, there is provided a temperature-stabilizing packaging container for sensitive products in closed tubes, especially semi-solid test media such as immersion nutrient substrate carriers for the determination of micro-organisms or the like, which comprises a strip-like, heat-insulating material, at least one of the surfaces of which is provided with a radiation-repelling, metallic covering.

In such a packaging container, the strip-like, heat-insulating material reduces the transmission of heat and the metallic coating suppresses the radiating in and out of heat. In this way, temperature fluctuations in the interior of the containers are substantially prevented not only in the direction of higher temperatures but also of lower temperatures. The temperature equilibration in the packaging container takes place much more slowly than in the case of packaging containers which are not protected against the influences of heat radiation, which results in a reduction or prevention of condensate formation because the aqueous substrate can again take up water from the air in the tube via the maintenance of the equilibrium. The storage stability of the nutrient substrate and especially of agar-containing nutrient substrates is considerably improved by the avoidance of a drying out thereof, without special temperature-controlled storage apparatus or rooms thereby being required. The packaging container can be produced in an economic manner. In spite of the heat-insulating and also the radiation-protecting construction, its dimensions are small and substantially adapted to the size of several tubes containing the test media. The production of waste is thus kept within acceptable limits.

The metallic coating is preferably provided on the outer surface of the strip-like material. Additionally providing the strip-like, heat-insulating material with a metallic coating on its inner surface further minimises the temperature fluctuations. Furthermore, it is advantageously influenced by using a strip-like, heat-insulating material with the greatest possible resistance to heat transmission. For this purpose, it is preferable to use a corrugated paper with fine undulations and especially a corrugated paper with microfine undulations, the air channels of which provide an excellent protection against the transmission of heat. Foamed materials or bubble films are also very suitable, in conjunction with a metallic coating on at least one surface, for a packaging container for sensitive products.

The radiation-repelling coating of the strip-like, heat-insulating material can be a metal coating or a metal foil lamina. The metallic coating preferably contains or consists of aluminium, tin or gold. Our investigations have shown that the outer surface of the metallic coating should be substantially free of radiation-absorbing coatings or coverings, i.e. printing the outer surface of the metallic coating with radiation-absorbing dyestuffs should be avoided. The metallic coating preferably has a polished surface but it can be advantageous to coat it with a lacquer as a protection against rubbing.

When the packaging container is made in the form of a box with an upper hinged cover, it is advantageous to provide the box with at least one horizontal partition with holes therein. The holes in the partition serve to keep in an upright position closed tubes containing semi-solid test media placed in the box. The tubes are, in this manner, held spaced apart from one another and also from the wall of the packaging container. Consequently, an additional reduction of the influence of heat on the contents of the tubes is achieved and a further improvement of the storage stability of the nutrient substrates is achieved. The holding function of the partition or partitions also has the advantage that the tubes stand firmly and, when transporting or handling the packaging container, they cannot fall about or become damaged. When two partitions are provided, it is advantageous when they are produced from a single strip of material folded in the form of an asymmetrical, angular spiral to form a box-like body, the two ends of which are closed by hinged covers. The assembled box-like body is placed in the packaging container and constitutes a further element for increasing the heat-insulating effect of the packaging container as a whole.

In the following, there are given experimental results obtained by comparing the properties of a packaging containers according to the present invention with those of a conventional packaging container.

The temperature variations were determined in a conventional packaging container consisting of simple cardboard, the outer surface of which is provided with a dark colour and is printed in black and in a packaging container according to the present invention made of corrugated paper with microfine undulations, the outer surface of which is covered with aluminium foil. Both packaging containers contained 10 immersion nutrient substrate carriers in closed synthetic resin tubes. The results obtained are set out in the following Table:

| place of measurement | temperature °C. | Δt/140 | Δt/h. |
|---|---|---|---|
| commencement of the experiment | 22 | | |
| after heat stressing for 140 min.: | | | |
| interior of packaging container according to the present invention | 28.7 | 6.7 | 2.9 |
| interior of the comparison packaging container | 34.5 | 12.5 | 5.4 |
| external temperature | 31.9 | 9.9 | 4.2 |

The two packaging containers were kept during the experiment on a table in a conventional laboratory at a temperature of 22° C. Heat stressing was carried out by means of incandescent lamps (150 W) placed at a distance of 50 cm. from the upper surface of the packaging containers. The measurements were carried out with Pt 100 in the middle of the packaging containers.

The temperature in the comparison packaging container increased within the experimental period of 140 minutes about twice as quickly as in the packaging container according to the present invention. Indeed, due to the heating up by the radiation which had penetrated, the increase of the temperature in the comparison packaging container was, at the end of the experiment, about 2.60° C. above the surrounding outside temperature.

The course of the temperature after removing the source of heat proceeded smoothly in the case of the packaging container according to the present invention, whereas, in the case of the comparison packaging container, it again took place about twice as quickly.

It is thus shown that the construction of a packaging container in the manner according to the present invention enables the period of storage stability of, for example, immersion nutrient substrate carriers or of nutrient substrates in Petri dishes, which is only limited under normal storage conditions, to be more than doubled.

For a better understanding of the present invention, reference will now be made to the accompanying drawings, in which:

FIG. 1 is a view of a packaging container according to the present invention with two horizontal partitions;

FIG. 2 is a partial section of the wall material of the packaging container according to FIG. 1;

FIG. 3 is a view of the box-like body containing the two horizontal partitions; and FIG. 4 is a section of the box-like body of FIG. 3 along the line IV—IV.

Referring now to FIG. 1, a packaging container 1 comprises a rectangular box, the upper opening 2 of which can be closed by two narrow side flaps 3 and 4 and a lid 5 with an insertion lip 6. The packaging container 1 is produced from a folding-box blank made of double micro-undulating corrugated paper 7 and preferably of cellulosic material (FIG. 2), the outer surface of which is covered with a metallic lamina 8 of, for example, aluminium. The corrugated paper 7 has especially small undulations, i.e. the height of the undulations is very small and the number of air channels 10 between the two smooth paper covering strips 9, the inner of which preferably consists of white cellulose, is extraordinarily large. This provides a very great resistance to the transmission of heat by the carrier material serving to reduce the heat transmission for the aluminium foil 8, which reduces the amount of heat entering and leaving the packaging container 1 so that balanced temperature conditions prevail within the interior thereof.

In the hollow space of the packaging container 1 there is fitted a box-like body 11 which has an upper partition 12 and lower partition 13, the two partitions 12 and 13 being arranged horizontally and spaced apart. Each partition is provided with parallel rows of holes 14 and 15, the holes 14 and 15 being arranged coaxially with one another. These holes serve to hold tubes 16 in an upright position. The tubes 16 are closed with caps 17 and can contain, for example, immersion nutrient substrate carriers for the determination of micro-organisms in serological and microbiological diagnosis.

The box-like body 11 is produced from a folding box-like cardboard blank which forms a box with three horizontal partitions folded in the form of an asymmetrical, angular spiral. The expression "asymmetrical, angular spiral" is to be understood to mean the cross-sectional path of the cardboard blank illustrated in FIG. 4. A low side wall 18 continues as a lower horizontal holed partition 13, which continues as a second low side wall 19 so that a profile results which, in cross-section, is U-shaped. The second side 19 continues as a non-holed base 20 running parallel to the partition 13, from which a high side wall 21 continues which is continued by an upper holed partition 12 which continues as a second high side wall 22. The outer surfaces of the low side walls 18 and 19 are connected, for example by adhesives, to the inner surfaces of the high side walls 21 and 22.

The ends of the box-like body 11 are closed by means of folding flaps 23, 24 and 25, the folding flap 25 thereby having an insert lip 26.

When the box-like body 11 is placed in the packaging container 1, the upper partition 12 is at least so far below the upper edge of the packaging container 1 that the caps 17 of the tubes 16 are above the partition 12. The height of the two lower side walls 18 and 19 should be such that the two partitions 12 and 13 are so spaced apart from one another that the tubes 16 are securely held against tilting in the holes 14 and 15.

We claim:

1. A temperature-stabilizing packaging container for condensation-sensitive, water-containing products in closed tubes, especially semi-solid test media such as immersion nutrient substrate carriers for the determination of micro-organisms or the like, comprising: a strip-like, heat-insulating material forming the packaging container; and metallic covering means on at least one of the surfaces of the packaging container for repelling heat-producing radiation.

2. A packaging container according to claim 1, wherein the metallic covering means is provided at least on the outer surface of the packaging container.

3. A packaging container according to claim 1 or 2, wherein the strip-like, heat-insulating material is paperboard or cardboard.

4. A packaging container according to claim 1 or 2, wherein the strip-like heat-insulating material is a corrugated paper with fine or micro-fine undulations.

5. A packaging container according to claim 1 or 2, wherein the strip-like, heat-insulating material is a foamed material.

6. A packaging container according to claim 1 or 2, wherein the strip-like, heat-insulating material is a bubble film.

7. A packaging container according to claim 1 or 2, wherein the metallic covering means is a metal foil lamina.

8. A packaging container according to claim 1 or 2, wherein the metallic covering means is a metal coating.

9. A packaging container according to claim 1 or 2, wherein the metallic covering means comprises one or more of the materials selected from the group consisting of aluminum, tin, and gold.

10. A packaging container according to claim 1 or 2, wherein the outer surface of the metallic covering means is substantially free from radiation-absorbing coatings.

11. A packaging container according to claim 10, wherein the outer surface of the metallic covering means is polished.

12. A packaging container according to claims 1 or 2, wherein the strip-like, heat-insulating material forms the packaging container as a box with a hinged lid, and further comprising at least one horizontal partition with holes therein in the box.

13. A packaging container according to claim 12, and further comprising a second horizontal partition, both partitions being parts of the strip-like, heat-insulating material forming the packaging container, the strip-like, heat-insulating material being folded in the form of an asymmetrical, angular spiral to form the packaging container as a box-like body with folding flaps for the two ends of the box-like body.

14. A packaging container according to claim 13, wherein both the horizontal partitions have hole openings arranged coaxially.

15. A packaging container according to claim 1, substantially as hereinbefore described and exemplified and with reference to the accompanying drawings.

* * * * *